United States Patent [19]

De Palma et al.

[11] 4,452,158

[45] Jun. 5, 1984

[54] PRESSER FOOT CONTROL FOR SEWING MACHINES

[75] Inventors: Giovanni De Palma, S. Fermo; Bruno Motta, Milan, both of Italy

[73] Assignee: Rockwell-Rimoldi S.p.A., Milan, Italy

[21] Appl. No.: 373,480

[22] Filed: Apr. 30, 1982

[30] Foreign Application Priority Data

Jun. 2, 1981 [IT] Italy ..... 22097 A/81

[51] Int. Cl.[3] ..... D05B 29/02

[52] U.S. Cl. ..... 112/235

[58] Field of Search ..... 112/235, 237, 312, 320

[56] References Cited

U.S. PATENT DOCUMENTS

| | | | |
|---|---|---|---|
| 2,419,494 | 4/1947 | Knaus | 112/237 |
| 3,796,173 | 3/1974 | Godsen | 112/235 |
| 3,933,106 | 1/1976 | Murray | 112/235 |
| 4,024,826 | 5/1977 | Knight et al. | 112/235 |
| 4,381,722 | 5/1983 | Takeuchi et al. | 112/235 |

FOREIGN PATENT DOCUMENTS

| | | | |
|---|---|---|---|
| 1020853 | 12/1957 | Fed. Rep. of Germany | 112/235 |

*Primary Examiner*—Henry Jaudon
*Assistant Examiner*—Andrew M. Falik

[57] ABSTRACT

A low-inertia presser device for sewing machines having a coil spring operatively connected to a pivotably mounted arm that carries the machine's presser foot. The spring is housed within a sleeve having a bifurcated end that straddles the arm. A thrust rod protruding from the sleeve has one end in engagement with the coil spring and the opposite end with that portion of the pivotably mounted arm extending through the bifurcated end of the sleeve. The biasing force of the coil spring is effective in minimizing the inertia of the moving parts and is effective in causing the presser foot to precisely and consistently track the movement of the feed dog above the needle plate, resulting in controlled movement of a workpiece in a straight line along the sewing axis.

2 Claims, 3 Drawing Figures

8
9
4

1
2
5
6
7
24
23
10
8
9
III
11
13
4
21
20
19
18
III
17
3
16
15

PRESSER FOOT CONTROL FOR SEWING MACHINES

BACKGROUND OF THE INVENTION

The present invention pertains to a low-inertia presser device for sewing machines which is effective in maintaining positive control of a workpiece being advanced by the combined efforts of said machine's presser foot and feed dog. Such control maintains the base of the presser foot in positive contact with the workpiece during displacement of the feed dog above the needle plate, and eliminates the possibility of movement of the workpiece other than rectilinearly along the sewing axis.

Devices for controlling presser elements in sewing machines are known to those conversant in the sewing art, such as the teachings disclosed in British Pat. No. 161,487 and U.S. Pat. No. 2,712,803. Although the devices of these patents have satisfactorily performed their intended functions, they have not provided what is considered as a low-inertia device for control of a machine's presser foot. One of the known types of presser control devices utilizes an elongated member that is acted on by a leaf spring and, being operatively connected to the machine's presser foot, has the disadvantage of additional inertia of said spring which, because of its size, has a substantial moment of inertia.

Another known type of presser control which utilizes an arm for supporting the machine's presser foot applies what is considered a considerable amount of weight at the location of the pressure media on said arm, and with the guide for the latter not being sufficiently precise so as to provide positive and repeated accuracy of movement of said presser foot.

The presser foot control according to the present invention eliminates the disadvantages associated with the presser devices of the prior art by providing a device which minimizes the inertia of the moving parts, i.e. the presser foot, the bar which supports said presser foot, the coil spring, and its supporting sleeve operatively associated with said bar. Additionally, the device of the invention is effective in maintaining a workpiece in positive alignment with the direction of its feed and in causing a desirable release and rotation of the presser arm around a vertical axis.

An object and advantage of the invention is that of causing the underside of the presser foot to accurately and consistently track the movement of the feed dog during the latter's movement above the needle plate so as to effect controlled movement of a workpiece in a straight line along the sewing axis.

SUMMARY OF THE INVENTION

The object and advantages of the invention are obtained by a low-inertia presser device for sewing machines which includes a coil spring operatively connected to an arm that supports the machine's presser foot and which is housed within a guide sleeve. One end of this sleeve is bifurcated and straddles the arm, and a thrust rod is interposed between the spring and the arm. One end of this thrust rod is in contact with the coil spring and extending through an opening in the bottom of the guide sleeve, the opposite end engages the upper surface of that portion of the arm extending between the bifurcated end of the sleeve and is effective in transmitting the biasing force of the coil spring to the machine's presser foot.

These and other objects and advantages of the present invention will become more fully apparent by reference to the appended claims and as the following detailed description proceeds in reference to the figures of drawing wherein:

DESCRIPTION OF THE PREFERRED EMBODIMENT

Figures 1, 3:
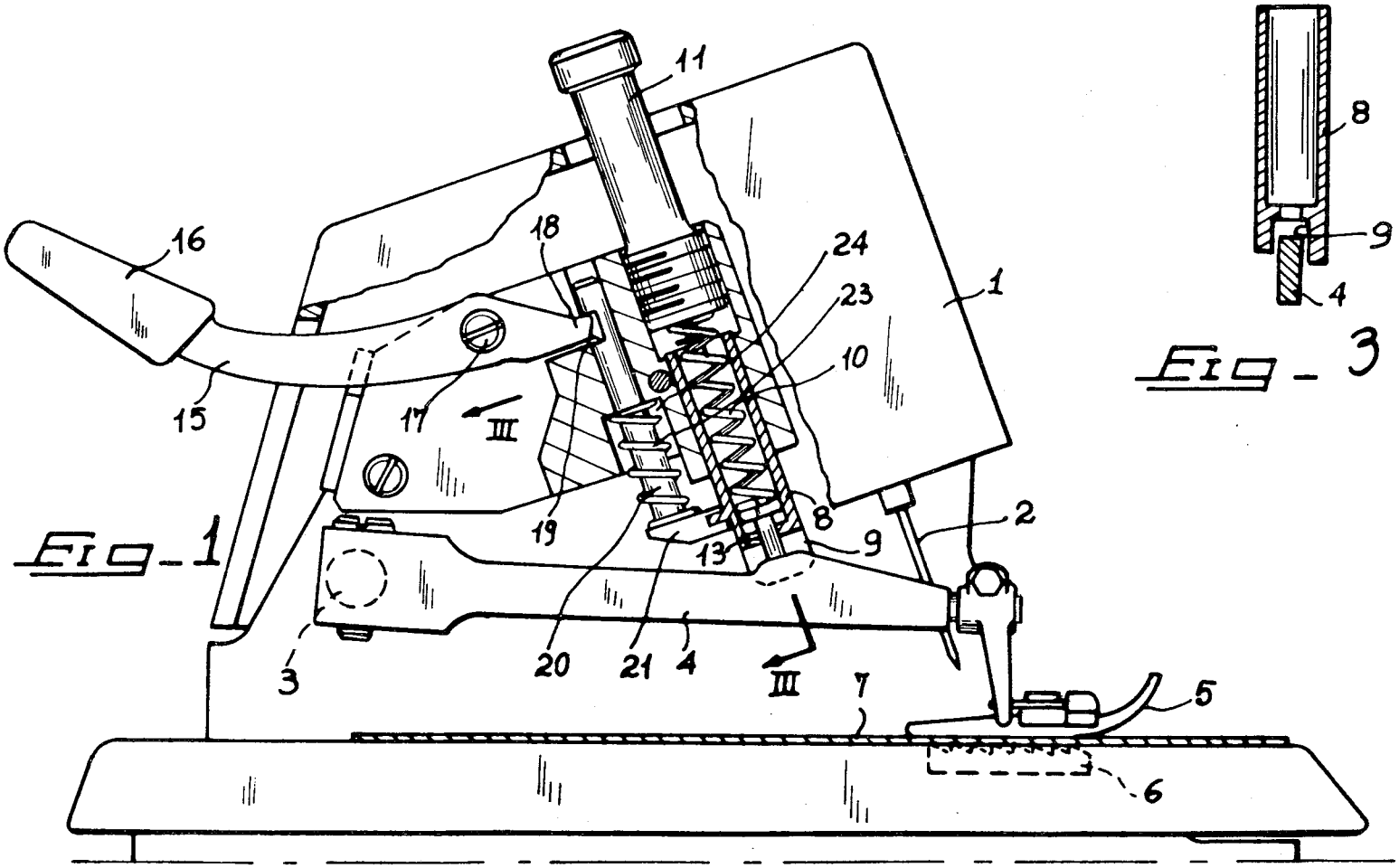
FIG. 1 is a view in side elevation and partially in section of a portion of a sewing machine showing the device according to the invention applied thereto.
FIG. 3 is a sectional view as seen looking in the direction of the indicating arrows of line III—III in FIG. 1.
Figure 2:
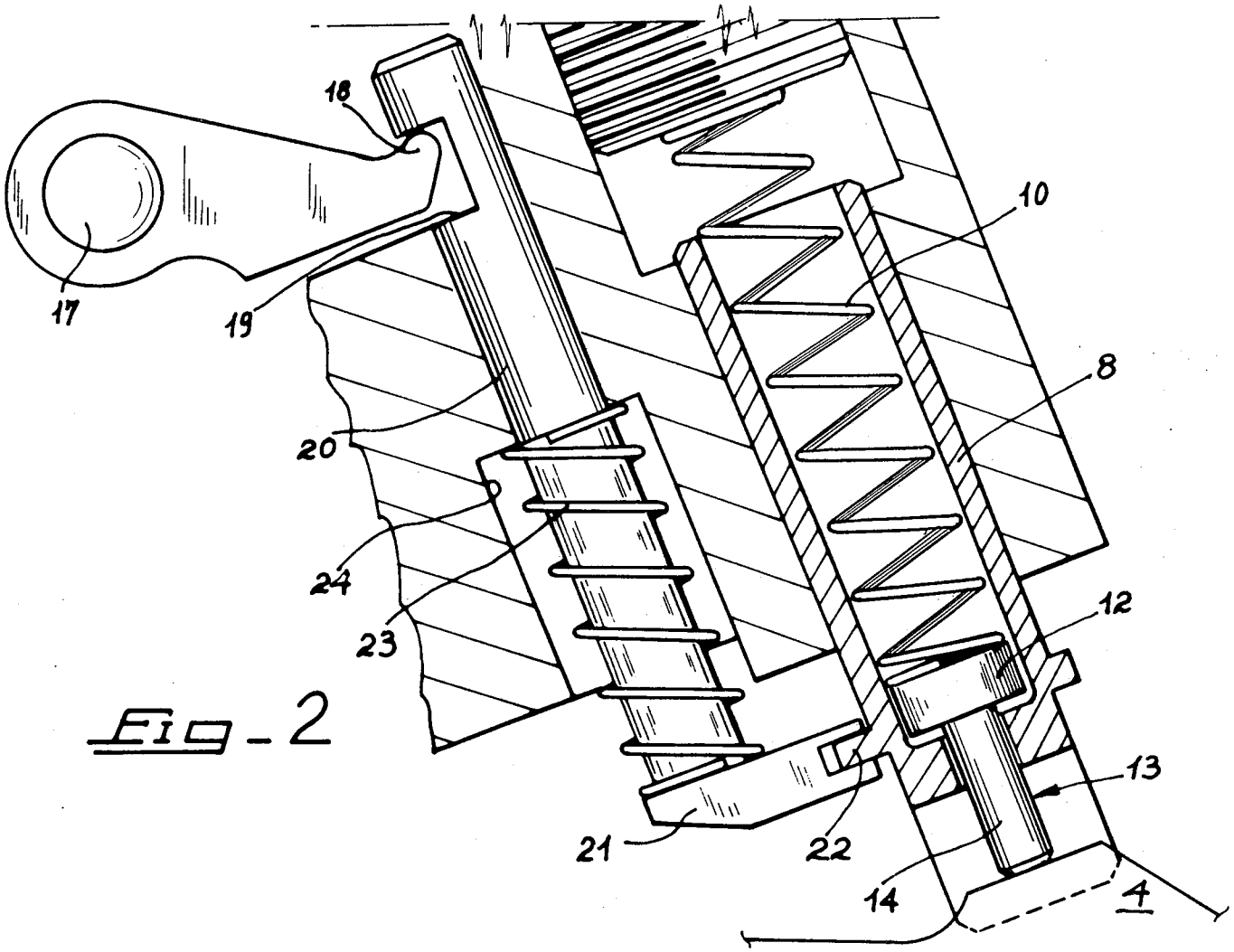
FIG. 2 is an enlarged view of the device according to the invention shown in FIG. 1.

Referring to FIG. 1 of the drawings wherein only as much of the sewing machine structure is depicted as is necessary for complete understanding of the invention, there is shown a conventional sewing machine head depicted by numeral 1. This sewing machine head 1 supports the usual form of needle 2 that is reciprocally driven by a conventional drive (not shown). A horizontally disposed pin 3 pivotably supports one end of an elongated arm 4 which at its free end supports the machine's presser foot that is identified by numeral 5. In a conventional manner, the presser foot is located directly above the feed dog 6 that is driven in the usual rectilinear pathway by a well known form of drive (not shown). This rectilinear pathway includes an ascent movement so as to partially protrude above the macine's work surface 7, a horizontal feed movement, a descent movement below said work surface, and thence a horizontal movement opposite in direction to its feed movement. Above the elongated arm 4 a cylindrical guide sleeve 8 is assembled and is provided with a bifurcated lower end as at 9 which is disposed so as to straddle the arm 4 as shown in FIGS. 1 and 3.

A coil spring 10 is housed within the guide sleeve 8 and its upper end is disposed so as to engage a knurled knob 11. This knob 11 can be manually rotated in one direction or the other so as to selectively control the biasing force with which the lower end of the coil spring 10 is caused to engage the head 12 of a thrust rod identified generally by numeral 13. This thrust rod 13 has a shank portion 14 extending from the head 12 through and beyond an opening in the lower end of the cylindrical guide sleeve 8.

The lower end of the shank portion 14 is located within the bifurcated end of the guide sleeve 8 where it is in operative engagement with the portion of the upper surface of the arm 4 which extends through said bifurcated end.

Both the head 12 and shank 14 of the thrust rod 13 slide along the inner lower walls of the guide sleeve 8 while the arm 4 is subjected to similar displacement by means of the feed dog 6 acting on the presser foot 5 while traveling in its rectilinear pathway.

In the preferred embodiment, the thrust element is described as having the configuration of a rod 13 that includes a head 12 and a shank portion 14 that is in operative engagement with the arm 4. However, this thrust element could be modified whereby other elements could be utilized to perform the same function, such as a sphere member being acted upon by the spring 10, or with said spring 10 being in direct contact with the arm 4.

It should be understood that any modification of the rod 13 would be provided with a suitable means for retaining the spring 10 within the sleeve 8 when the latter is selectively raised from operative association with the arm 4.

The spring 10 is set to effect the necessary opposed force between the presser foot 5 and feed dog 6 so as to provide an adequate feed pressure for a workpiece. In the preferred embodiment, the spring 10 can be of substantially lesser strength for it is adapted to act on the thrust rod 13 of insignificant weight and mass, relative to the bar arrangement of the prior art. The present spring arrangement is readily adapted to follow the displacement of the presser foot and a workpiece and, by eliminating a substantial amount of reciprocating mass, a far less rigid spring can be successfully utilized.

With this thrust rod and spring arrangement there is also a substantial decrease in the pulsating forces set up by the acceleration of the presser foot when the feed dog descends below the work surface, and especially at high operating speeds. At high operating speeds there is a decrease in the difference between the static pressure force of the spring and the supplementary and reduced forces due to inertia on acceleration and deceleration, respectively, of the reciprocating masses.

To raise the sleeve 8, an arm 15 is provided having one end that defines a handle 16 and which is pivotably mounted intermediate its ends as at 17. The end of the arm 15 opposite its handle 16 is identified by numeral 18 and is disposed in operative engagement with a groove 19 provided in and adjacent the upper end of a rod 20 that is slidably mounted in the head 1.

The lower end of the rod 20 has a laterally extending forked element 21 fixed thereon with the forked portion thereof being operatively engaged with an integral flange 22 formed adjacent the lower end of the sleeve 8.

A coil spring 23 assembles on rod 20 intermediate the forked element 21 and a seat 24 for the spring formed in the head 1. It should be obvious that the lowering of arm 15 by handle 16 will move rod 20 upwardly, causing sleeve 8 to move in a like manner whereby the bifurcated end 9 is raised above the arm 4 which can then be turned about a vertical axis perpendicular to the horizontal pin 3.

When the arm 15 is released, the tendency of the coil spring 23 to seek its free length is effective in lowering the guide sleeve 8 to its operating position. Spring 23 is weaker than spring 10 as it simply serves to lower the sleeve to a position where the bifurcated end 9 straddles the arm 4 so as to maintain the latter in alignment with the direction of feed of a workpiece.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

We claim:

1. A low-inertia presser device for sewing machines of the type having a head with an elongated arm mounted thereto for supporting the macine's presser foot in operative association with its feed dog and work surface, said presser device comprising:

(a) a guide sleeve (8) mounted in the head including:
  (i) a bifurcated lower end (9) straddling the elongated arm to prevent lateral movement thereof;
(b) a coil spring (10) housed within said guide sleeve; and
(c) a thrust rod (13) having a head portion disposed in sliding contact with the lower portion of the inner wall of said guide sleeve and a shank portion of lesser diameter than said head portion extending outwardly from said guide sleeve, said thrust rod being interposed between the lower end of said coil spring and the presser foot to exert biasing force thereagainst.

2. The structure according to claim 1 wherein said thrust rod (13) is slidably contained within said guide sleeve (8) and includes:

(i) a head portion (12) in contact with one end of said coil spring (10); and
(ii) a shank portion (14) extending from guide sleeve (8) to a position of operative contact with the elongated arm extending between the bifurcated end (9) of said guide sleeve.

* * * * *